US008673211B1

(12) United States Patent
Lema et al.

(10) Patent No.: US 8,673,211 B1
(45) Date of Patent: Mar. 18, 2014

(54) METHOD TO REDUCE CORROSION OF ALUMINUM ALLOYS EXPOSED TO SEAWATER

(75) Inventors: Luis E. Lema, North Attleboro, MA (US); Robert J. Angeli, Portsmouth, RI (US)

(73) Assignee: The United States of America as repesented by the Secretary of Navy, Washington, DC (US)

( * ) Notice: Subject to any disclaimer, the term of this patent is extended or adjusted under 35 U.S.C. 154(b) by 363 days.

(21) Appl. No.: 13/134,958

(22) Filed: Jun. 1, 2011

(51) Int. Cl.

| | |
|---|---|
| ***C23F 11/00*** | (2006.01) |
| *B01D 47/00* | (2006.01) |
| *B01D 53/56* | (2006.01) |
| *C01B 17/20* | (2006.01) |
| *C23F 11/04* | (2006.01) |

(52) U.S. Cl.
USPC ..... 422/7; 423/243.05; 423/269

(58) Field of Classification Search
USPC ..... 422/7; 423/243.05, 269
See application file for complete search history.

(56) References Cited

U.S. PATENT DOCUMENTS

| | | | | | |
|---|---|---|---|---|---|
| 3,716,604 | A | * | 2/1973 | Dehm | 264/3.1 |
| 3,808,061 | A | * | 4/1974 | Pierce | 149/18 |
| 3,923,564 | A | * | 12/1975 | Lantz | 149/19.8 |
| 6,032,460 | A | * | 3/2000 | Pahl | 60/39.6 |

* cited by examiner

*Primary Examiner* — Regina M Yoo
(74) *Attorney, Agent, or Firm* — James M. Kasischke; Jean-Paul A. Nasser; Michael P. Stanley

(57) ABSTRACT

A method is taught to alleviate some of the expected seawater corrosion of aluminum alloy fuel tanks originating from the chlorides present in seawater through the use of a dicarboxylic acid additive that is added to the aluminum alloy fuel tank when seawater enters the tank.

15 Claims, No Drawings

METHOD TO REDUCE CORROSION OF ALUMINUM ALLOYS EXPOSED TO SEAWATER

STATEMENT OF GOVERNMENT INTEREST

The invention described herein may be manufactured and used by or for the Government of the United States of America for governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates to the reduction of corrosion of aluminum alloys exposed to seawater, and more specifically to a novel use of buffering dicarboxylic organic acids in combination with Otto fuel and seawater.

(2) Description of the Prior Art

Corrosion of aluminum alloy Otto fuel tanks exposed to seawater is an on-going issue that requires mitigation and/or resolution. This issue is originated when residual seawater makes its way inside the fuel tank that has been partially fuel depleted. Presently the aluminum alloys are anodized and protected with an inert solid organic epoxy coating. In many instances this coating is partially lost due to handling/abuse of the fuel tank. As fuel tanks age the exposure of seawater to the aluminum alloy results in corrosion of the aluminum. Chlorides from seawater are corrosive to aluminum and its alloys at all temperatures and all chloride concentrations. There is a need to alleviate the chloride corrosion of fuel tanks due to the cost of fuel tank replacement.

SUMMARY OF THE INVENTION

It is a general purpose and object of the present invention to alleviate some of the expected seawater corrosion of aluminum alloy fuel tanks originating from the chlorides present in seawater.

This object is accomplished through the use of a dicarboxylic acid based chemical additive that can either be added to Otto fuel or can be applied to the interior of the tank. The dicarboxylic acid additive serves as a buffer to the aluminum alloy fuel tank when seawater enters the tank.

DESCRIPTION OF THE INVENTION

The main ingredient of the chemical additive of the present invention is a dicarboxylic organic acid HOOC—R—COOH, where R may be an alkyl, alkenyl, akynyl, or aryl group. In a preferred embodiment sebacic acid HOOC—$(CH_2)_8$—COOH is used, although azelaic acid HOOC—$(CH_2)_7$—COOH is also an option. An advantage of using sebacic acid is that dibutyl sebacate is one of the components (22.5% by weight) of Otto fuel. The first step is to partially react the sebacic acid to make either a salt of sebacic acid such as zinc monohydrate sebacate or aluminum monohydrate sebacate, or an ester such as butyl monohydrate sebacate. When making the salt of the sebacic acid, the reaction with zinc or aluminum must occur at precise thermal conditions. The next step is to add 2-nitrodiphenylamine at a percentage of 6.25% to the salt or ester of sebacic acid, as a further and final component of the chemical additive of the present invention. The 2-nitrodiphenylamine is used in the same ratio as in the formulation of Otto fuel to avoid contamination. The completed chemical additive of the present invention results in one of the acids still being active.

The next step is to combine the chemical additive of the present invention with Otto fuel or in the alternative to a delivery medium or mechanism that will allow it to be applied to the interior surface of the aluminum alloy fuel tank. In one embodiment, the additive is combined with a chemically neutral grease that is applied to the interior of the fuel tanks. In another embodiment, the additive is sprayed as a liquid on to the interior of the fuel tanks. In a further embodiment, the additive is applied to the interior of the fuel tanks through cathodic application.

The advantages of the present invention over the prior art is that the HOOC chain of the acid will attach to the aluminum alloy surface, which is what serves as a buffer (constant pH=5.9) to the seawater and protects the metal. In addition, a salt or ester of the sebacic acid will not contaminate (i.e. alter or react chemically with) the Otto fuel. Contamination of Otto fuel with organic materials, for example, could lead to serious mishaps.

In light of the above, it is therefore understood that within the scope of the appended claims, the invention may be practiced otherwise than as specifically described.

What is claimed is:

1. A method for reducing corrosion of aluminum alloys exposed to seawater comprising:

providing a dicarboxylic organic acid;

reacting the dicarboxylic organic acid to make a salt of the dicarboxylic organic acid;

adding 2-nitrodiphenylamine at a percentage of 6.25% to the salt of the dicarboxylic organic acid;

exposing the mixture of 2-nitrodiphenylamine and the salt of dicarboxylic organic, acid to the interior surface of an aluminum alloy fuel tank for use with Otto fuel.

2. The method of claim 1 wherein the dicarboxylic organic acid is sebacic acid.

3. The method of claim 2 wherein the salt of dicarboxylic organic acid is zinc monohydrate sebacate.

4. The method of claim 2 wherein the salt of dicarboxylic organic acid is aluminum monohydrate sebacate.

5. The method of claim 1 wherein the step of exposing the mixture of 2-nitrodiphenylamine and the salt of dicarboxylic organic acid to the interior surface of an aluminum alloy fuel tank comprises adding the mixture of 2-nitrodiphenylamine and the salt of dicarboxylic organic acid to a quantity of Otto fuel for use in said aluminum alloy fuel tank.

6. The method of claim 1 wherein the step of exposing the mixture of 2-nitrodiphenylamine and the salt of dicarboxylic organic acid to the interior surface of an aluminum alloy fuel tank comprises:

combining the mixture of 2-nitrodiphenylamine and the salt of dicarboxylic organic acid with a chemically neutral grease; and applying the combined chemically neutral grease and mixture of 2-nitrodiphenylamine and the salt of dicarboxylic organic acid to the interior surface of the aluminum alloy fuel tank.

7. The method of claim 1 wherein the step of exposing the mixture of 2-nitrodiphenylamine and the salt of dicarboxylic organic acid to the interior surface of an aluminum alloy fuel tank comprises:

combining the mixture of 2-nitrodiphenylamine and the salt of dicarboxylic organic acid with a chemically neutral liquid; and spraying the combined chemically neutral liquid and mixture of 2-nitrodiphenylamine and the salt of dicarboxylic organic acid to the interior surface of the aluminum alloy fuel tank.

8. The method of claim 1 wherein the step of exposing the mixture of 2-nitrodiphenylamine and the salt of dicarboxylic organic acid to the interior surface of an aluminum alloy fuel tank comprises applying the mixture of 2-nitrodiphenylamine and the salt of dicarboxylic organic acid to the interior surface of the aluminum alloy fuel tank through cathodic application.

9. A method for reducing corrosion of aluminum alloys exposed to seawater comprising:

providing a dicarboxylic organic acid;

reacting the dicarboxylic organic acid to make an ester of the dicarboxylic organic acid;

adding 2-nitrodiphenylamine at a percentage of 6.25% to the ester of the dicarboxylic organic acid;

exposing the mixture of 2-nitrodiphenylamine and the salt of dicarboxylic organic acid to the interior surface of an aluminum alloy fuel tank for use with Otto fuel.

10. The method of claim 9 wherein the dicarboxylic organic acid is sebacic acid.

11. The method of claim 10 wherein the ester of dicarboxylic organic acid is butyl monohydrate sebacate.

12. The method of claim 9 wherein the step of exposing the mixture of 2-nitrodiphenylamine and the ester of dicarboxylic organic acid to the interior surface of an aluminum alloy fuel tank comprises adding the mixture of 2-nitrodiphenylamine and the ester of dicarboxylic organic acid to a quantity of Otto fuel for use in said aluminum alloy fuel tank.

13. The method of claim 9 wherein the step of exposing the mixture of 2-nitrodiphenylamine and the ester of dicarboxylic organic acid to the interior surface of an aluminum alloy fuel tank comprises:

combining the mixture of 2-nitrodiphenylamine and the ester of dicarboxylic organic acid with a chemically neutral grease; and applying the combined chemically neutral grease and mixture of 2-nitrodiphenylamine and the ester of dicarboxylic organic acid to the interior surface of the aluminum alloy fuel tank.

14. The method of claim 9 wherein the step of exposing the mixture of 2-nitrodiphenylamine and the ester of dicarboxylic organic acid to the interior surface of an aluminum alloy fuel tank comprises:

combining the mixture of 2-nitrodiphenylamine and the ester of dicarboxylic organic acid with a chemically neutral liquid; and spraying the combined chemically neutral liquid and mixture of 2-nitrodiphenylamine and the ester of dicarboxylic organic acid to the interior surface of the aluminum alloy fuel tank.

15. The method of claim 9 wherein the step of exposing the mixture of 2-nitrodiphenylamine and the ester of dicarboxylic organic acid to the interior surface of an aluminum alloy fuel tank comprises applying the mixture of 2-nitrodiphenylamine and the ester of dicarboxylic organic acid to the interior surface of the aluminum alloy fuel tank through cathodic application.

* * * * *